US012082722B2

(12) United States Patent
Vega

(10) Patent No.: US 12,082,722 B2
(45) Date of Patent: Sep. 10, 2024

(54) PICTURE FRAME AND MAT SYSTEM

(71) Applicant: Maria Vega, Seattle, WA (US)

(72) Inventor: Maria Vega, Seattle, WA (US)

( * ) Notice: Subject to any disclaimer, the term of this patent is extended or adjusted under 35 U.S.C. 154(b) by 112 days.

(21) Appl. No.: 17/985,820

(22) Filed: Nov. 12, 2022

(65) Prior Publication Data

US 2023/0172374 A1 Jun. 8, 2023

Related U.S. Application Data

(60) Provisional application No. 63/285,151, filed on Dec. 2, 2021.

(51) Int. Cl.
*A47G 1/06* (2006.01)

(52) U.S. Cl.
CPC ..... *A47G 1/06* (2013.01); *A47G 2001/0666* (2013.01); *A47G 2001/0672* (2013.01)

(58) Field of Classification Search
CPC ..... A47G 1/06; A47G 2001/0666; A47G 2001/0672
See application file for complete search history.

(56) References Cited

U.S. PATENT DOCUMENTS 1,342,477 A * 6/1920 Walas ..... A47G 1/06 40/742
5,283,967 A * 2/1994 Abrams ..... G09F 1/12 40/773
6,845,582 B1 * 1/2005 Ho ..... A47G 1/06 40/721
2009/0217563 A1 * 9/2009 Useche ..... A47G 1/14 40/779
2011/0131855 A1 * 6/2011 Heeps ..... A47F 7/142 40/792
2014/0000140 A1 * 1/2014 Fredette ..... D05B 97/10 40/777
2014/0237874 A1 * 8/2014 Tanaka ..... A47G 1/06 40/760
2019/0269262 A1 * 9/2019 Kacius ..... A47G 1/1613
2023/0263318 A1 * 8/2023 Heeps ..... A47F 7/14 40/745

* cited by examiner

*Primary Examiner* — Gary C Hoge
(74) *Attorney, Agent, or Firm* — Walker Griffin Weitzel; Alloy Patent Law

(57) ABSTRACT

Presented is a Picture frame for visually displaying a picture template. The picture frame includes a base, a top cover, an internal backing, and a mat. The base includes a first side, a second side disposed opposite to the first side, and a peripheral portion extending along the entire perimeter of the first side and the second side. The first side of the base includes raised projections. An internal backing is positioned on the raised projections and the internal backing is removably connected to a magnet. The mat includes a plurality of locking tabs for releasably holding the picture template. The mat further includes a ferromagnetic metal plate. The picture frame enables quick and easy picture template replacement of picture template and the picture in the picture frame.

24 Claims, 7 Drawing Sheets

PICTURE FRAME AND MAT SYSTEM

CROSS-REFERENCE TO RELATED PATENT DOCUMENTS

This patent application claims the benefit of priority of U.S. Provisional Application No. 63/285,151, entitled "PICTURE FRAME AND MAT SYSTEM," filed 2 Dec. 2021, which is hereby incorporated herein by reference in its entirety.

TECHNICAL FIELD

The present invention generally relates to art and pictures and more particularly, the present invention relates to a picture frame and a mat system that allows a user to present the picture templates in the picture frame, and the picture templates can be easily and quickly replaced in the picture frame.

BACKGROUND

Generally, pictures are displayed in a picture frame for aesthetic appeal and to improve the durability of the picture. Picture frames are easily available in the market and they are often available in various shapes, sizes, materials, and designs to meet the user requirement. Frames may be mass-produced in standard sizes, or they can be custom-made for specific art.

Many people enjoy refreshing their display of framed art by replacing the picture within the frame. Replacing the picture in a picture frame is a time-consuming task that also can require some skill. At a minimum, a user is required to remove a framed picture from the wall, remove any backing to access the picture, remove the photo from the matting, position the photo precisely in order to display it properly, adhere the photo precisely in place, replace any backing, secure everything within the frame, re-hang the picture frame on the wall, and level it. Some users opt to have the task professionally handled. In either case, many people opt not to change out their displayed picture due to the inconvenience or cost.

Various types of picture frames for easy picture replacement are known in the prior art. For example, US20070204500A1 discloses a front-loading display system adapted for safe, frequent, and rapid change of displayed objects. The display system includes a base and an object-holding assembly. The object-holding assembly can be releasably attached to the base through the use of a fastener, which allows the base to remain mounted to a mounting surface when changing display objects. In a preferred embodiment, the fastener employs magnetic force to connect the base and the object-holding assembly. The display object is retained between a resting plate and a cover plate, the two plates being releasably attached to each other by the use of at least one holding device, which may be selected from clips, clasps, hinges and elastic bands.

US20100011644A1 discloses a system for displaying memorabilia includes a display platform, at least one sheet of mounting material, and a cover. The mounting material is arranged and configured to be assembled into a first display piece, wherein when the first display piece is assembled, the first display piece includes at least two facing layers of mounting material fastened together and at least a first magnet fastened to one of the at least two facing layers of mounting material. The first magnet is arranged and configured to secure the display piece to the display platform. A first combined thickness of at least two facing layers of mounting material and the first magnet define a first height. The cover encloses the display platform and has a transparent surface that permits viewing at least one display piece when the cover is closed and when the display piece is secured to the display platform.

Other solutions include updating photos by creating mass-produced tile-like canvases (e.g., Mix tiles) that can be moved and repositioned on walls for new galleries. This solves the problems of time; however, these solutions create a great amount of waste. Old items must be stored or thrown out when new ones arrive. They are bulky and can be damaged in storage, so they are often thrown away.

The existing solution related to picture frames increases manufacturing complexities and costs related to the picture frames. Further, these picture frames do not effectively and efficiently provide a quick and easy picture replacement of picture in the picture frame.

In the light of the foregoing, there is a need for an effective and inexpensive solution that would allow a user to can be easily and quickly replace picture templates in the picture frame. Thus, an easy to update picture frame is needed.

SUMMARY

It is an objective of the present invention to provide a picture frame having a front access such that the frame is not required to be removed from the wall during picture template replacement.

It is an objective of the present invention to provide a picture frame that enables a user to easily and quickly replace the picture template in the picture frame.

It is another objective of the present invention to provide a mat that releasably holds a picture template wherein the mat could be easily removed from the picture frame to permit easy replacement of the picture template from the mat.

It is an objective of the present invention to provide a picture frame that utilizes magnetic attraction (force) to removably hold picture templates in the picture frame.

It is an objective of the present invention to provide a picture frame that does not need any special tools for replacing picture templates in the picture frame.

It is an objective of the present invention to provide a picture template that comprises at least one picture provided with a frame. The picture template is configured to align the picture in the mat and allows for the picture to be secured in the picture frame with perfect alignment.

It is an objective of the present invention to provide a guide template that assists to create exact alignment between the magnet of the internal backing and the ferromagnetic metal plate of the mat during the fabrication of the internal backing and the mat. The guide template is configured to be used in the production of the picture frame to align magnet(s) of the internal backing and the ferromagnetic metal plate of the mat.

Embodiments of the present invention disclose a Picture frame for displaying a picture template. The picture frame comprises: a top cover comprising a cover plate; a base comprising a first side, an opposite second side, and a peripheral portion; A mat comprising a comprising a viewing region and at least one ferromagnetic metal plate; An internal backing positioned between the raised projections(s) of the base and the mat, wherein the mat is releasably holding the picture template. The first side of the base comprises a plurality of raised projections. A magnet is permanently or removably connected to the internal backing such that the magnet lies in the gap between the plurality of raised projections. The peripheral portion of the base is rotatably connected to the top cover. The mat further comprising a plurality of locking tabs for releasably holding the picture template.

Embodiments of the present invention disclose a picture frame for displaying a picture template, the picture frame comprising: a top cover comprising a cover plate; a base comprising a first side, an opposite second side, and a peripheral portion; Wherein the first side comprising a plurality of raised projections; and the peripheral portion is rotatably connected to the top cover; an internal backing positioned on the plurality of raised projections; wherein the internal backing is removably connected to at least a magnet; a mat comprising a viewing region and at least one ferromagnetic metal plate, wherein the mat further comprising a plurality of locking tabs for releasably holding the picture template; Wherein the mat releasably holding a picture template is sandwiched between the top cover and the internal backing.

In an embodiment, the cover plate as well as the viewing region is transparent to allow for viewing the picture template.

In an embodiment, the cover plate as well as the viewing region includes an aperture for viewing the picture template.

In an embodiment, the first side of the base further comprises at least one magnetic closure element, and the top cover comprises at least one magnetic closure element to ensure magnetic locking of cover with the first side of the base when the top cover is in the closed position.

In an embodiment, one side of the top cover is hingedly connected to a peripheral portion of the base using hinges.

In an embodiment, the second side of the base comprises a hook/hole for attaching the picture frame to a rigid structure.

In an embodiment, the picture frame could include a guide template to create exact alignment between the magnets of the internal backing and the ferromagnetic metal plate of the mat during the fabrication of the internal backing and the mat. The guide template is configured to be used in the production of the picture frame to align magnet(s) of the internal backing and the ferromagnetic metal plate. After production of the picture frame, the guide template is removed from the picture frame and is stored for later use.

In an embodiment, the magnets of the internal backing are at least substantially concealed from the eyes of the viewer.

In an embodiment, the picture template has a displaying portion and a non displaying portion.

In an embodiment, the locking tabs are configured to move relative to the mat such that the locking tabs have a locked position and an unlocked position, wherein in the locked position, the locking tabs is configured to releasably hold the picture template and wherein in the unlocked position, the locking tabs are configured to release the picture template.

In an embodiment, the ferromagnetic metal plate is bulge shaped in nature.

In an embodiment, the ferromagnetic metal plate of the mat is configured to magnetically attract the magnets of the internal backing.

Embodiments of the present invention disclose a picture frame for displaying a picture template, the picture frame comprising: a top cover comprising a cover plate; a base comprising a first side, an opposite second side, and a peripheral portion; Wherein the first side comprising a plurality of raised projections; and the peripheral portion is rotatably connected to the top cover; an internal backing positioned on the plurality of raised projections; At least one magnet laying in a gap formed between the plurality of raised projections and the internal backing; a mat comprising a viewing region and at least one ferromagnetic metal plate, wherein the ferromagnetic metal plate of the mat is configured to magnetically attract the magnets to retain the picture template sandwiched between the mat and the internal backing wherein a viewer can see the picture template through the viewing region f the mat and the cover plate.

In an embodiment, the cover plate as well as the viewing region is transparent to allow for viewing the picture template.

In an embodiment, the cover plate as well as the viewing region includes an aperture for viewing the picture template.

In an embodiment, the first side of the base further comprises at least one magnetic closure element, and the top cover comprises at least one magnetic closure element to ensure magnetic locking of cover with the first side of the base when the top cover is in the closed position.

In an embodiment, one side of the top cover is hingedly connected to a peripheral portion of the base using hinges.

In an embodiment, the second side of the base comprises a hook/hole for attaching the picture frame to a rigid structure.

In an embodiment, the picture frame could include a guide template to create exact alignment between the magnets of the internal backing and the ferromagnetic metal plate of the mat during the fabrication of the internal backing and the mat. The guide template is configured to be used in the production of the picture frame to align magnet(s) of the internal backing and the ferromagnetic metal plate. After production of the picture frame, the guide template is removed from the picture frame and is stored for later use.

In an embodiment, the magnets are at least substantially concealed from the eyes of the viewer.

In an embodiment, the mat further comprising a plurality of locking tabs for releasably holding the picture template.

The present invention provides a picture frame that allows a user to easily and quickly replace picture templates in the picture frame. These and other features and advantages of the present invention will become apparent from the detailed description below, in light of the accompanying drawings

DETAILED DESCRIPTION

Figure 1:
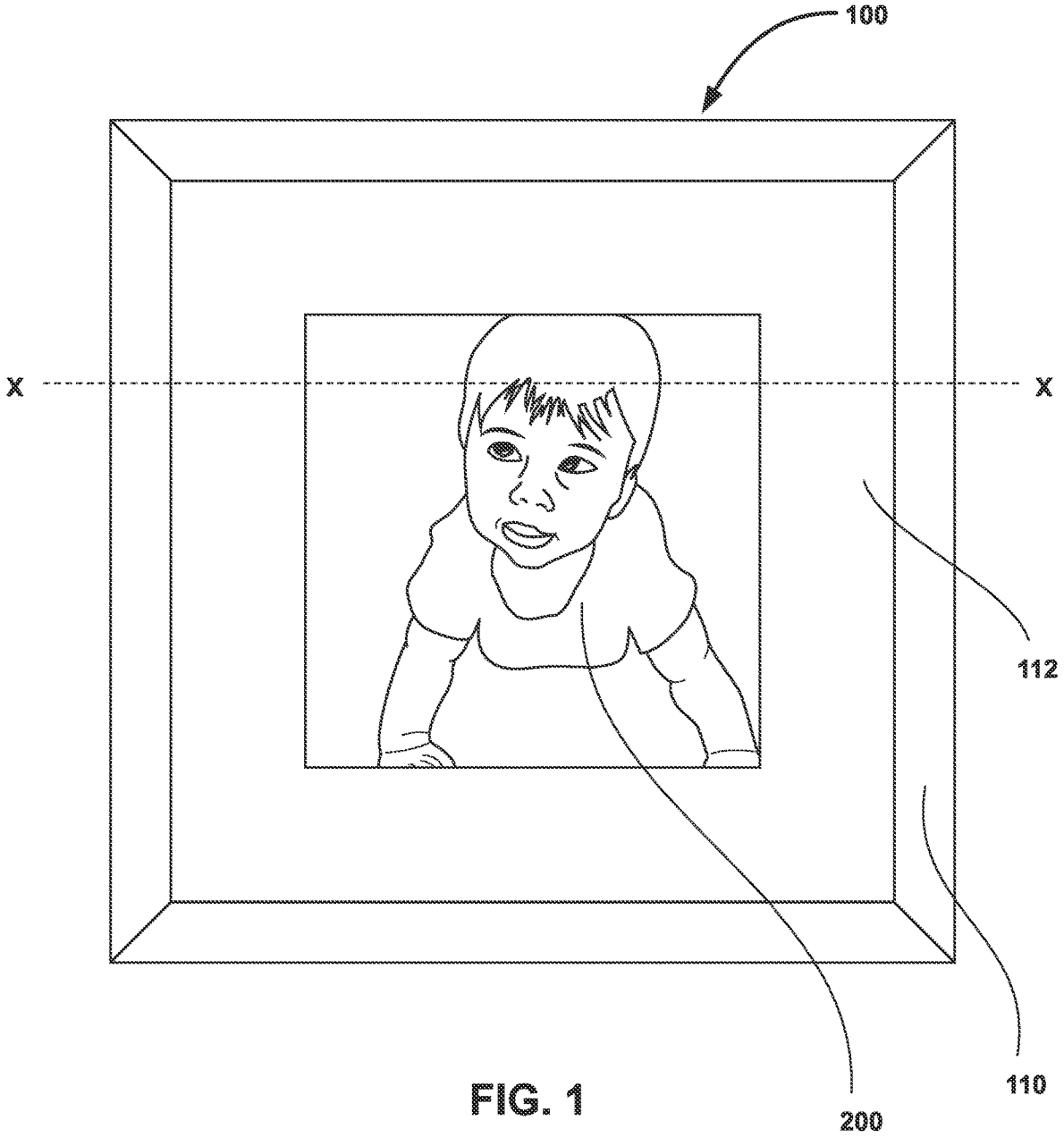
FIG. 1 shows a front view of a picture frame with a top cover in a closed position and a picture template displayed in the picture frame, according to an embodiment of the invention.

Before describing the present invention in detail, it should be observed that the present invention utilizes a combination of components or processes, which constitutes a picture frame for displaying picture templates. Accordingly, the components or processes have been represented, showing only specific details that are pertinent for an understanding of the present invention so as not to obscure the disclosure with details that will be readily apparent to those with ordinary skill in the art having the benefit of the description herein. As required, detailed embodiments of the present invention are disclosed herein; however, it is to be understood that the disclosed embodiments are merely exemplary of the invention, which can be embodied in various forms. Therefore, specific component-level details and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

References to "one embodiment", "an embodiment", "another embodiment", "one example", "an example", "another example" and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in an embodiment" does not necessarily refer to the same embodiment. The words "comprising", "having", "containing", and "including", and other forms thereof, are intended to be equivalent in meaning and be open ended in that an item or items following any one of these words is not meant to be an exhaustive listing of such item or items or meant to be limited to only the listed item or items.

The picture frame will now be described with reference to the accompanying drawings, particularly FIGS. 1-5.

Referring to FIG. 1-4, The picture frame 100 comprises a top cover 110, a base 120, an internal backing 123, and a mat 130 which will be described in greater detail in the below description accompanying figures.

FIG. 1 illustrates a front view of a picture frame 100 with a top cover 110 in a closed position and a picture template 200 displayed in the picture frame 100, according to an embodiment of the invention. In an embodiment, the top cover 110 comprises a cover plate 112 which is formed of transparent material such as but not limited to: glass, plastics, and so on such that the picture template 200 is visible to a viewer through the cover plate 112.

In another embodiment, the cover plate 112 includes an aperture (not shown in figures) such that a viewer can see the picture template 200 through the aperture (not shown in figures) of the cover plate 112.

Figure 2:
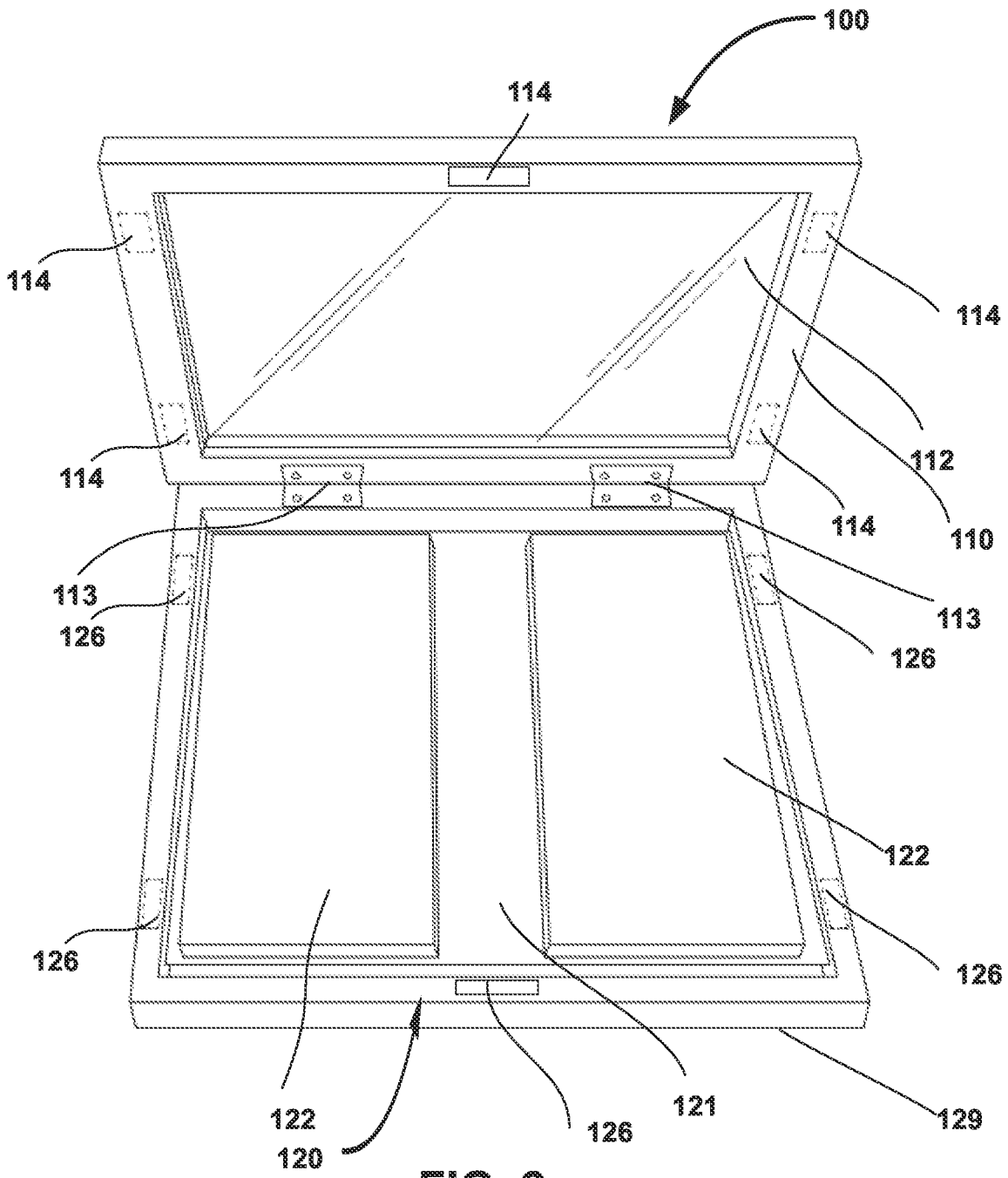
FIG. 2 shows a front perspective view of the picture frame of FIG. 1 with the top cover in an opened position, with the mat and internal backing removed for simplicity and ease of understanding.
Figure 2A:
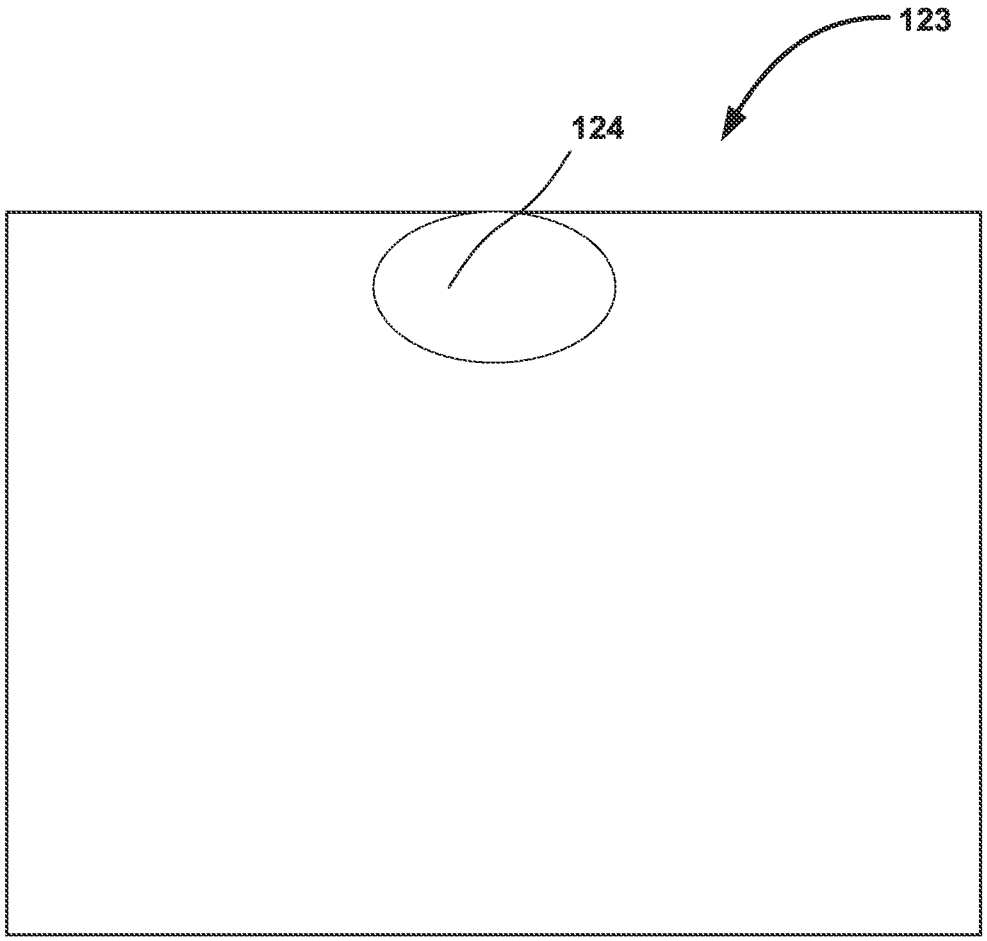
FIG. 2A shows a front perspective view of the internal backing of the picture frame of FIG. 1.
Figure 4:
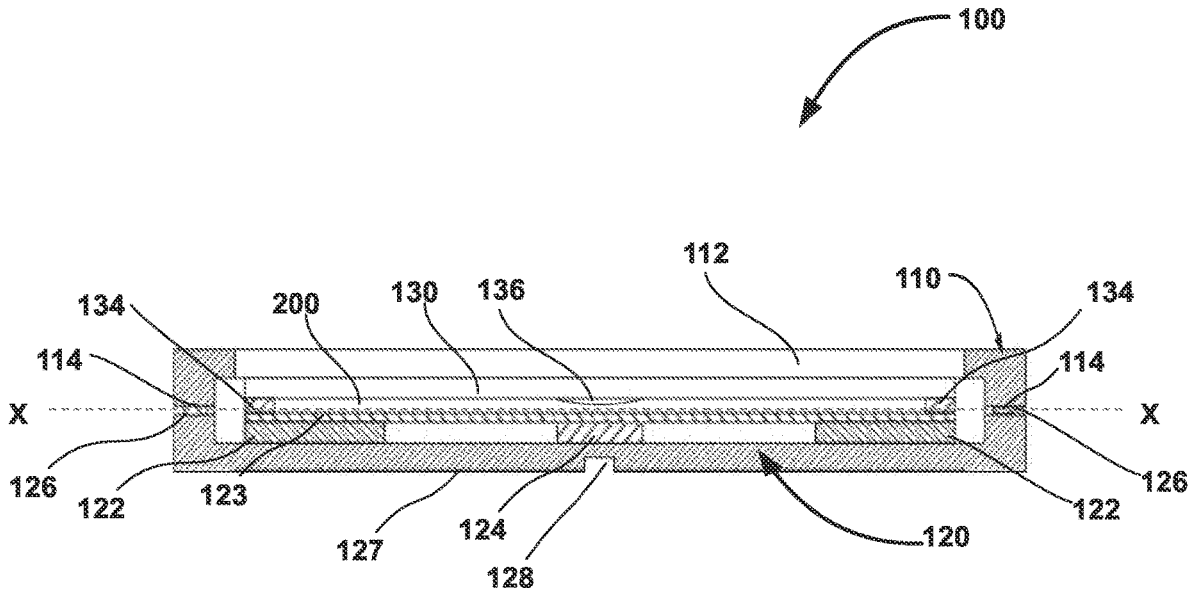
FIG. 4 shows a perspective cross-sectional view of the picture frame of FIG. 1 with the top cover in the closed position, according to an embodiment of the present invention.

Referring to FIG. 2 and FIG. 2A, the picture frame 100 comprises a base 120. The base comprises a first side 121, a second side 127 (FIG. 4) disposed opposite to the first side 121, and a peripheral portion 129 extending along the entire perimeter of the first side 121 and the second side 122. The first side 121 of the base 120 comprises a plurality of raised projections 122 such that there is a substantial gap (depth) between the plurality of raised projections 122. As shown in FIG. 4, an internal backing 123 is placed on the raised projections 122, and at least one magnet 124 removably connected to the internal backing 123 such that the magnet(s) 124 lies in the gap between the plurality of raised projections 122. The magnet 124 is substantially circular in shape. However, the magnet could have various other shapes such as but not limited to: rectangle, square, triangle, and so on. Thus, magnet(s) 124 is not visible to a person when the picture frame 100 is empty (does not have any picture template 200) or during the replacement of the picture template 200 and for safety as shown in FIG. 4. The magnet(s) 124 is not accessible directly without removing the internal backing 123. Thus, the magnet(s) 124 are at least substantially concealed from the eyes of the viewer. The opposite second side 127 (FIG. 4) of the base 120 faces a wall (not shown) and the opposite second side 127 of the base 120 comprises a hook/hole 128 (FIG. 4) for attaching the picture frame 100 to a wall (not shown). The peripheral portion 129 of the base 120 is rotatably connected to the one side of the top cover 110 by hinges 113.

The base 120 is formed of a substantially rigid material such that the base 120 is capable of supporting the installation of the picture frame 100 to a structure such as but not limited to: wall, panels and so on. The base 120 can include any material and is preferably comprised of corrosion-resistant rigid material. In an exemplary embodiment, the base includes a material selected from wood, polymers, composites, metal (e.g., corrosion-resistant metal, such as aluminium), coated metal and combinations thereof. Exemplary polymers include plexiglass, vinyl, acrylics, polystyrene, polycarbonate and other plastics. It is well within the abilities of a skilled person to select a suitable base material depending on parameters, such as required stability, required size as well as type, and intensity of use. In a preferred embodiment, the base 120 is essentially made of a member selected from woods and polymeric material, such as acrylics.

In an embodiment, the first side 121 of the base 120 further comprises at least one magnetic closure element 126, and the top cover 110 comprises at least one magnetic closure element 114 to ensure magnetic locking of cover 110 with the first side 121 of the base 120 when the top cover 110 is in closed position as shown in FIG. 1.

In an embodiment as shown in FIG. 2, the magnetic closure element 114 is imbedded within the top cover 110 opposite the hinged side wherein the hinged side of the top cover 110 has hinges 113. Further, the magnetic closure element 126 is imbedded in base 120 opposite the hinged side wherein the hinged side of the base 120 has hinges 113 attached on that side. It ensures that the top cover 110 is in closed position in natural relaxed state due to hinge action of the hinges 113 from a side and magnet locking action of the magnetic closure element 114 and magnetic closure element 126 on the opposite side.

Figure 3A:
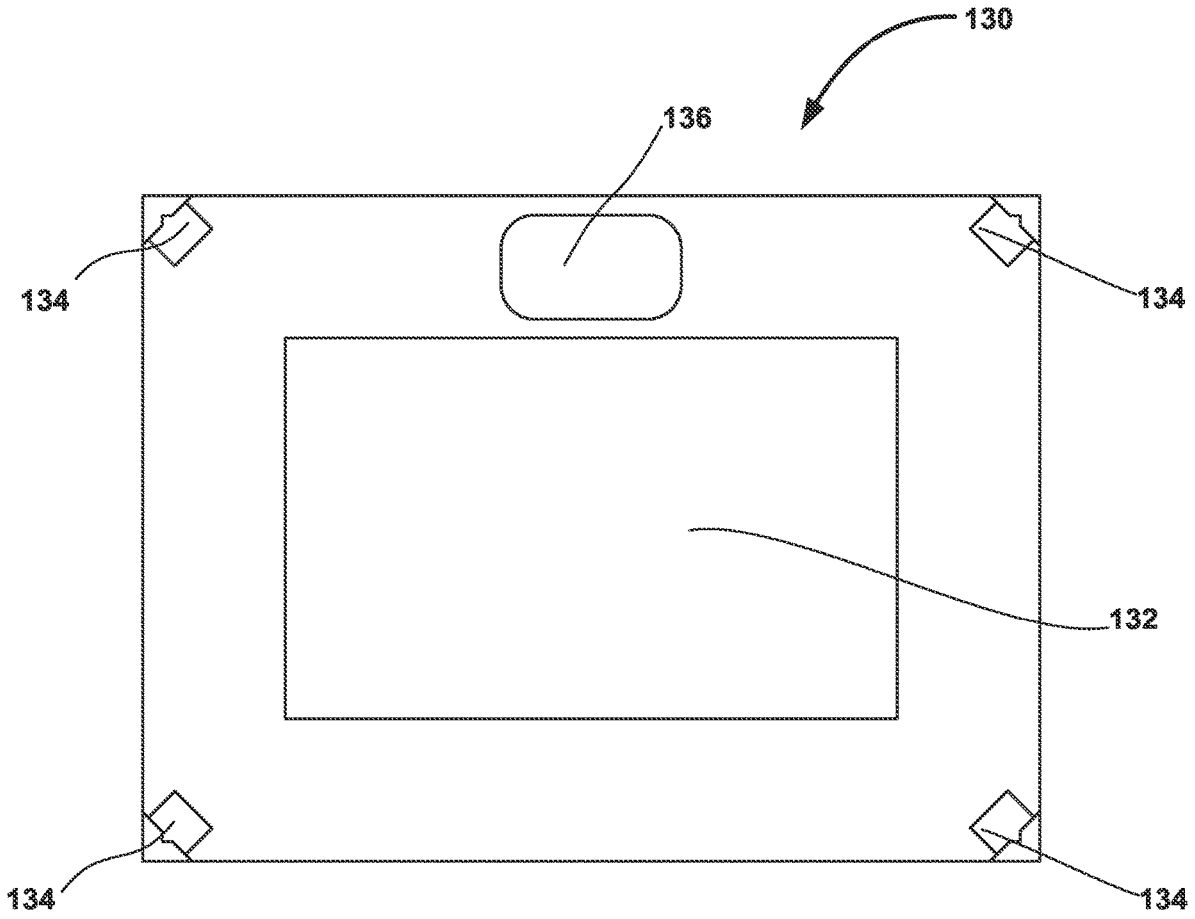
FIG. 3A shows a front perspective view of a mat of the picture frame of FIG.1, according to an embodiment of the present invention.

Referring to FIG. 3A, a front perspective view of a mat 130 of the picture frame 100 is shown, according to an embodiment of the invention. The mat 130 comprises a viewing region 132 for enabling viewers to see the picture template 200 (FIG. 1) through the viewing region 132. In an embodiment, the viewing region 132 could be a through slot (aperture). In another embodiment, the viewing region 132 could be made of a transparent material. The mat 130 further comprises a plurality of locking tabs 134 for releasably holding a picture template 200 (FIG. 1). The mat 130 further comprises at least one ferromagnetic metal plate 136. The ferromagnetic metal plate 136 has a shape of a chamfered quadrilateral and is slightly bulged as seen in FIG. 3A and FIG. 4. The bulge shaped nature of the ferromagnetic metal plate 136 is configured to effectively magnetically attract the magnet(s) 124 of the internal backing 123 and/or slight stretching of the picture template 200. However, the ferromagnetic metal plate 136 could have various other shapes such as but not limited to: rectangle, square, triangle, and so on.

Figure 3B:
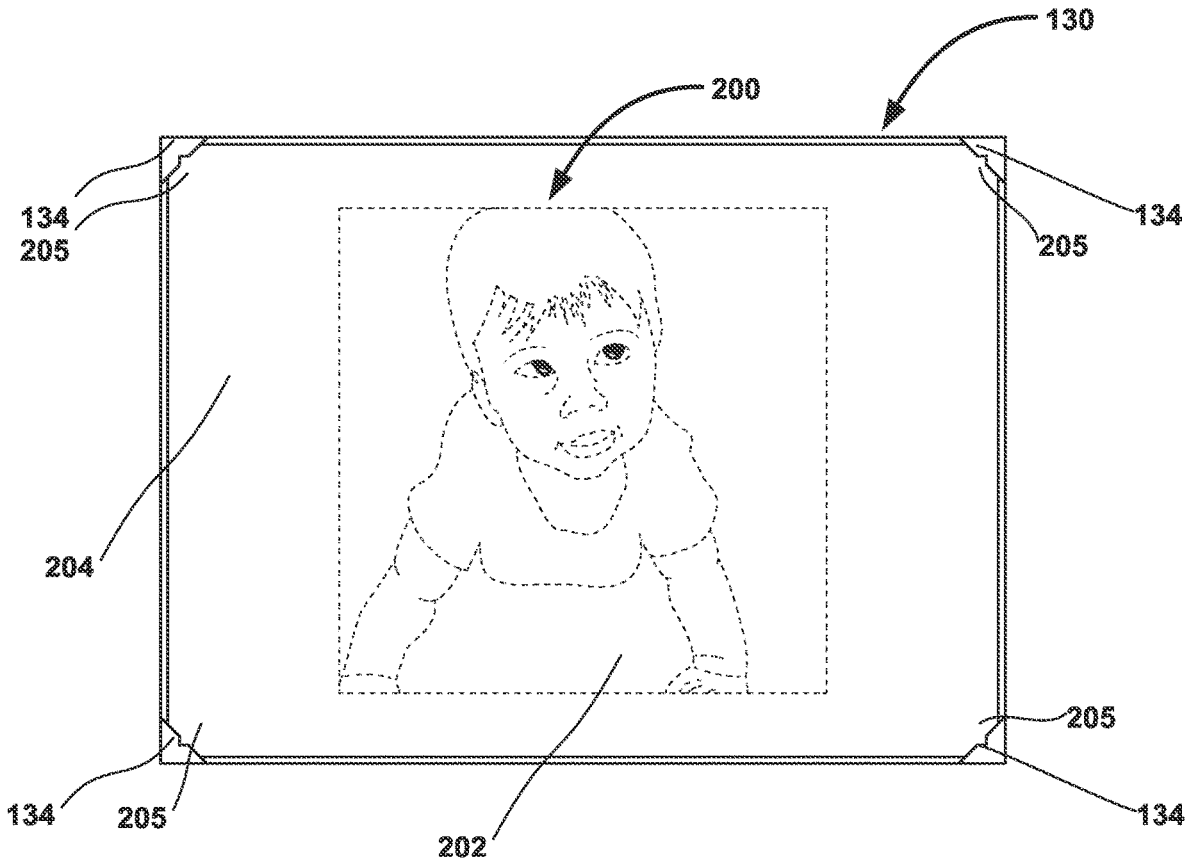
FIG. 3B shows a front perspective view of the mat of FIG. 3A releasably holding a picture template.

FIG. 3B is a front perspective view of the mat 130 of FIG. 3A releasably holding a picture template 200. The picture template 200 has a displaying portion 202 and a non displaying portion 204. The non displaying portion 204 is simply a flat piece of photographic paper without any visual content (pictures). The non displaying portion 204 is provided such that the non displaying portion 204 is not visible to the viewer and thus, only the displaying portion 202 is visible to the viewer. The non displaying region 204 is located around the outer periphery of the displaying portion 202. As seen in FIG. 3B, the corners 205 of the non displaying portion 204 are releasably locked by locking tabs 134 of the mat 130. In an embodiment, the locking tabs 134 are integrally connected to the mat 130. To replace an old picture template 200, the picture template 200 is slightly distorted by pushing the old picture template 200 against the mat 130 such that the old picture template is released from at least one locking tab 134. Afterward, the old picture template 200 is removed from the mat 130 and a new picture template 200' (not shown in figures) is added (updated) in the mat 130. It should be understood that the picture template 200 shown in dotted form (FIG. 3B) is facing in the opposite direction such that the picture template 200 shown in dotted form is facing towards the screen/page/back. Further, It should be understood that the picture template 200 shown in solid form (FIG. 1) is facing towards the front/reader opposite to FIG. 3B.

In an embodiment, the picture template 200 has only displaying portion 202 such that the picture template 200 does not have non displaying portion 204.

In another embodiment (not shown in figures), the locking tabs 134 are configured to move relative to the mat 130 such that the locking tabs 134 have a locked position and an unlocked position. The locking tabs 134 are selectively movable between the locked position and the unlocked position by rotating/sliding the locking tabs 134 relative to the mat 130. Thus, the old picture template 200 can be replaced by the new picture template 200' (not shown in figures) by bringing the locking tabs 134 in the unlocked position, then afterwards removing the old picture template 200 from the mat 130. Then the new picture template 200' (not shown in figures) is added in the mat 130 and the locking tabs 134 are brought in the locked position to releasably hold the new picture template 200' (not shown in figures).

FIG. 4 shows an overall perspective cross-sectional view of the picture frame 100 of FIG. 1 along axis X-X with the top cover 110 in the closed position, according to an embodiment of the present invention. As seen in FIG. 4, the second side 127 of the base 120 comprises a hook/hole 128 for attaching the picture frame 100 to a rigid structure (not shown) such as but not limited to: wall, panel, and so on. The locking tabs 134 of the mat 130 are releasably holding a picture template 200 and the mat 130 is positioned in the picture frame 100 such that the mat 130 is sandwiched between the top cover 110 and the internal backing 123. The internal backing 123 is positioned on the plurality of raised projections(s) 122 of the base 120 such that the internal backing 123 is positioned between the raised projections(s) 122 of the base 120 and the mat 130, wherein the mat 130 is releasably holding the picture template 200. A magnet(s) 124 is removably connected to the internal backing 123 such that the magnet(s) 124 lies in the gap between the plurality of raised projections 122. The ferromagnetic metal plate 136 of the mat 130 faces the picture template 200 and the ferromagnetic metal plate 136 is magnetically attracted to the magnet(s) 124 of the internal backing 123 such that the picture template 200 is positioned in place between the mat 130 and the internal backing 123. A viewer can view the displayed picture template 200 through the cover plate 112 of the top cover 110 and the viewing region 132 (FIG. 3A) of the mat 130.

An exemplary method of replacing the old picture template 200 from the picture frame 100 by a new picture template 200' (not shown in figures) in the picture frame 100 now will be described in reference to FIGS. 1-5.

Replacement of an old picture template 200 from the picture frame 100 by a new picture template 200' (not shown in figures) in the picture frame 100 will now be described in detail. As seen in FIG. 1, an old picture template 200 is displayed in the picture frame 100 when the top cover 110 is in closed position. Afterward, the top cover 110 is brought into the open position as seen in FIG. 2 by rotating the top cover 110 relative to the base 120 by using hinges 113. Afterward, the mat 130 releasably holding the old picture template 200 is removed from the picture frame 100 and then, the old picture template 200 is removed from the mat 130 by removing old picture template 200 from the locking tabs 134. Afterward, a new picture template 200' (not shown in figures) is added/updated in the mat 130 by adding/updating new picture template 200' (not shown in figures) in the locking tabs 134. Thus, the mat 130 is now releasably holding new picture template 200' (not shown in figures) and then, the mat 130 is added/updated in the picture frame 100. The ferromagnetic metal plate 136 of the mat 130 faces the picture template 200 and the ferromagnetic metal plate 136 is magnetically attracted to the magnet(s) 124 of the internal backing 123 such that the picture template 200 is positioned in place between the mat 130 and the internal backing 123. Then, the top cover 110 is brought into closed position by rotating the top cover 110 relative to the base 120 by using hinges 113. Thus, a new picture template 200' (not shown in figures) is now displayed in the picture frame 100 when the top cover 110 is in closed position.

At least one picture (not shown in figures) is printed on the picture template 200. The picture template 200 is a high quality—print paper that can include but not limited to: Picture Paper, Glossy Picture Paper, Matte Picture Paper, Lustre Picture Paper, Canvas Picture Paper, Woven Picture Paper, Textured Picture Paper and so on. The picture template 200 aligns the picture in the mat 130 and allows for the picture to be secured in the picture frame 100 with perfect alignment. Depending on the number of pictures to be displayed in a picture frame, the templates could be customized accordingly. The picture template 200 is easily storable and can easily be stacked one on another. Thus, a new picture template 200' (not shown in figures) could be installed in front of the old picture template 200 in the picture frame 100 such that there is no need of removing old picture templates 200 from the picture frame 100.

In an embodiment, at least one picture is printed on the displaying portion 202 of the picture template 200 itself such that the picture and the picture template 200 are integrally joined.

In another embodiment (not shown in figures), the picture and the picture template 200 are separate individual objects such that old picture could be removed from the picture template 200 and new picture could be removably connected to the picture template 200.

It should be noted that the term "picture" of the present invention is a broad term and it could mean any object, which can be displayed using the picture frame of the present invention. Exemplary "picture" include artwork, such as paintings, drawings, collages, photos, graphs and the like. The term also includes printed materials, such as tickets, menus, information pamphlets, certificates, sports-cards, postcards and the like. The term "picture" further includes objects, such as coins and other memorabilia, which can optionally be placed onto a soft carrier material, such as foam. The "picture" optionally includes matting. The matting can be any commercial or custom-made matting. In an exemplary embodiment the matting is a member selected from paper, plastic foil, cardboard and matting board.

The "picture" can be a thin object (e.g., paper or picture paper), but can also have significant thickness. For example, a painting painted on stretched canvas may be several centimeters thick. The actual size and shape of the "picture" is not considered a limiting embodiment of the present invention.

Figure 5:
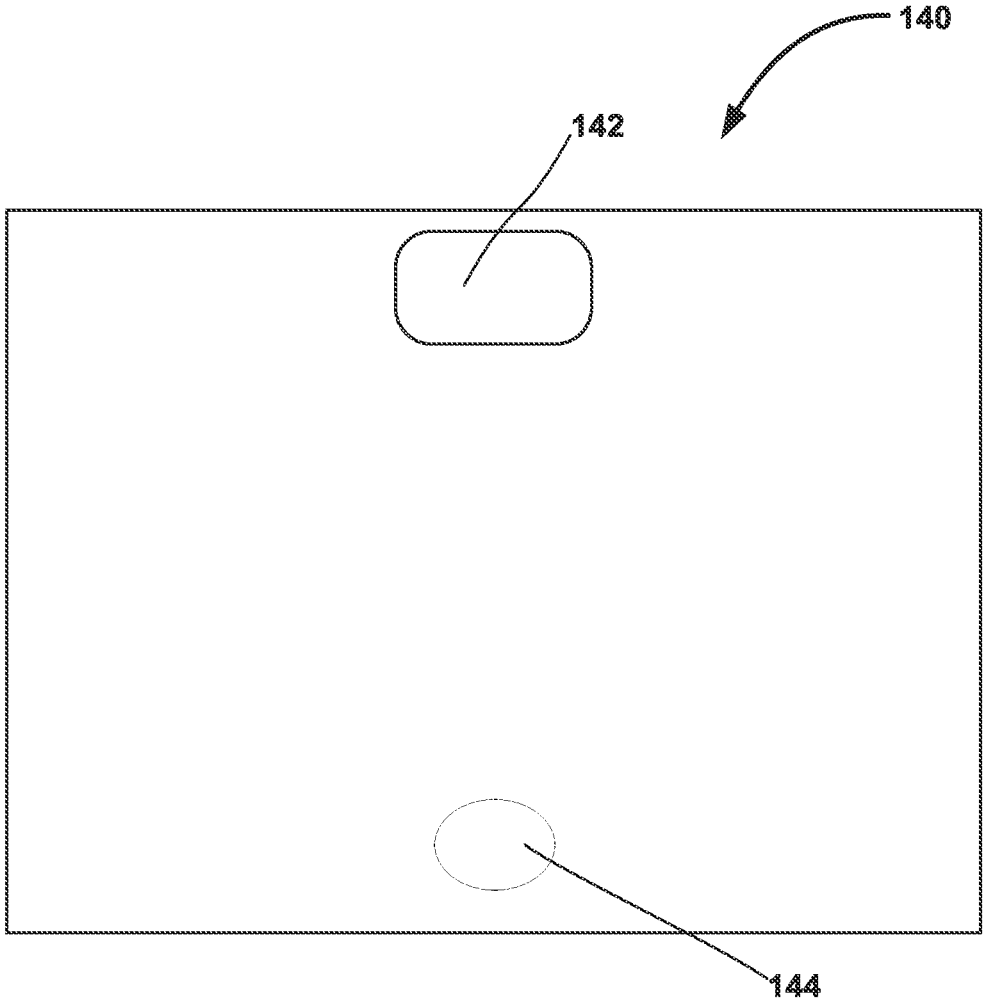
FIG. 5 shows a front perspective view of a guide template used for the alignment of magnet and ferromagnetic plate, according to an embodiment of the present invention.

FIG. 5 shows a front perspective view of a guide template 140 of the picture frame 100, according to an embodiment of the present invention. The guide template 140 assists to create exact alignment between the magnet(s) 124 of the internal backing 123 and the ferromagnetic metal plate 136 of the mat 130. The guide template 140 is useful during the attachment of the magnet(s) 124 on the internal backing 123 and the attachment of the ferromagnetic metal plate 136 on the mat 130 during fabrication of the internal backing 123 and the mat 130. The guide template 140 is configured to be used in the production of the picture frame 100 to align 124 of the internal backing 123 and the ferromagnetic metal plate 136 of the mat 130. After production of a picture frame 100, the guide template 140 is removed from the picture frame 100 and is stored for later use for production of another (next) picture frame 100 and so on. The guide template 140 comprises one through hole 142 and one circular hole 144. The guide template 140 is used to assemble the magnet(s) 124 and the ferromagnetic metal plate 136. A user can mark the preferred placement position of the magnet(s) 124 on the internal backing 123 by placing the guide template 140 on the internal backing 123 and marking the location of magnet(s) 124 on the internal backing 123 by using circular hole 144. Further, the user can rotate the guide template 140 by 180 degrees and then mark the preferred placement position of the ferromagnetic metal plate 136 of the mat 130 by placing the guide template 140 on the mat 130 and marking the location of ferromagnetic metal plate 136 of the mat 130 by using through hole 142.

It should be noted that the shape of the picture frame 100 and the parts of the picture frame 100 is not a limiting embodiment. The picture frame 100 could have any shape including but not limited to circle, oval, pentagon, trapezoidal and so on. Further, the magnet(s) 124 and the ferromagnetic plate 136 could have any shape including but not limited to circle, square, triangle and so on.

It should be noted that the terms "picture template" and "picture" are pretty similar and could be interchangeably used. For instance, the picture template could act as a "picture" in the picture frame 100. Further, terms such as "user" "person" and "viewer" are interchangeably used and have similar meaning.

It should be noted that the guide template 140 is not a functional (integral) component of the picture frame 100. The guide template 140 is only useful during the attachment of the magnet(s) 124 on the internal backing 123 and the attachment of the ferromagnetic metal plate 136 on the mat 130 during fabrication of the internal backing 123 and the mat 130. The guide template 140 is configured to be used in the production of the picture frame 100 to align magnet(s) 124 of the internal backing 123 and the ferromagnetic metal plate 136 of the mat 130. After production of a picture frame 100, the guide template 140 is removed from the picture frame 100 and is stored for later use to produce another (next) picture frame 100.

Although particular embodiments of the invention have been described in detail for purposes of illustration, various modifications and enhancements may be made without departing from the spirit and scope of the invention.

What is claimed is:

1. A picture frame (100) for displaying a picture template (200), the picture frame (100) comprising:

a top cover (110) comprising a cover plate (112);

a base (120) comprising a first side (121), an opposite second side (127), and a peripheral portion (129), wherein the first side (121) comprising a plurality of raised projections (122); and the peripheral portion (129) is rotatably connected to the top cover (110);

an internal backing (123) positioned on the plurality of raised projections (122); wherein the internal backing (123) is removably connected to at least a magnet (124);

a mat (130) comprising a viewing region (132) and at least one ferromagnetic metal plate (136), wherein the mat (130) further comprising a plurality of locking tabs (134) for releasably holding the picture template (200); and wherein the mat (130) releasably holding a picture template (200) is sandwiched between the top cover (110) and the internal backing (123).

2. The picture frame (100) for displaying a picture template (200) according to claim 1, wherein the cover plate (112) as well as the viewing region (132) is transparent to allow for viewing the picture template (200).

3. The picture frame (100) for displaying a picture template (200) according to claim 1, wherein the cover plate (112) as well as the viewing region (132) includes an aperture for viewing the picture template (200).

4. The picture frame (100) for displaying a picture template (200) according to claim 1, wherein the first side (121) of the base (120) further comprises at least one magnetic closure element (126), and the top cover (110) comprises at least one magnetic closure element (114) to ensure magnetic locking of cover (110) with the first side (121) of the base (120) when the top cover (110) is in closed position.

5. The picture frame (100) for displaying a picture template (200) according to claim 1, wherein one side of the top cover (110) is hingedly connected to a peripheral portion (129) of the base (120) using hinges (113).

6. The picture frame (100) for displaying a picture template (200) according to claim 1, wherein the second side (127) of the base (120) comprises a hook/hole (128) for attaching the picture frame (100) to a rigid structure.

7. The picture frame (100) for displaying a picture template (200) according to claim 1, wherein a guide template (140) is provided to create exact alignment between the magnet(s) (124) of the internal backing (123) and the ferromagnetic metal plate (136) of the mat (130) during fabrication of the internal backing (123) and the mat (130) of the picture frame (100).

8. The picture frame (100) for displaying a picture template (200) according to claim 1, wherein the magnet(s) (124) of the internal backing (123) are at least substantially concealed from the eyes of viewer.

9. The picture frame (100) for displaying a picture template (200) according to claim 1, wherein the picture template (200) has a displaying portion (202) and a non displaying portion (204).

10. The picture frame (100) for displaying a picture template (200) according to claim 1, wherein the ferromagnetic metal plate (136) is bulge shaped in nature.

11. The picture frame (100) for displaying a picture template (200) according to claim 1, wherein the ferromagnetic metal plate (136) of the mat (130) is configured to magnetically attract the magnet(s) (124) of the internal backing (123).

12. The picture frame (100) for displaying a picture template (200) according to claim 1, wherein at least one picture is printed on a displaying portion (202) of the picture template (200).

13. The picture frame (100) for displaying a picture template (200) according to claim 1, wherein the picture and the picture template (200) are separate individual objects that could be removably connected to each other.

14. A picture frame (100) for displaying a picture template (200), the picture frame (100) comprising:

a top cover (110) comprising a cover plate (112);

a base (120) comprising a first side (121), an opposite second side (127) and a peripheral portion (129), wherein the first side (121) comprising a plurality of raised projections (122); and the peripheral portion (129) is rotatably connected to the top cover (110);

an internal backing (123) positioned on the plurality of raised projections (122); At least one magnet (124) laying in a gap formed between the plurality of raised projections (122) and the internal backing (123);

a mat (130) comprising a viewing region (132) and at least one ferromagnetic metal plate (136), wherein the ferromagnetic metal plate (136) of the mat (130) is configured to magnetically attract the magnet(s) (124) to retain the picture template (200) sandwiched between the mat (130) and the internal backing (123), wherein a viewer can see the picture template (200) through the viewing region (132) of the mat (130) and the cover plate (112).

15. The picture frame (100) for displaying a picture template (200) according to claim 14, wherein the cover plate (112) as well as the viewing region (132) is transparent to allow for viewing the picture template (200).

16. The picture frame (100) for displaying a picture template (200) according to claim 14, wherein the cover plate (112) as well as the viewing region (132) includes an aperture for viewing the picture template (200).

17. The picture frame (100) for displaying a picture template (200) according to claim 14, wherein the first side (121) of the base (120) further comprises at least one magnetic closure element (126), and the top cover (110) comprises at least one magnetic closure element (114) to ensure magnetic locking of cover (110) with the first side (121) of the base (120) when the top cover (110) is in closed position.

18. The picture frame (100) for displaying a picture template (200) according to claim 14, wherein one side of the top cover (110) is hingedly connected to a peripheral portion (129) of the base (120) using hinges (113).

19. The picture frame (100) for displaying a picture template (200) according to claim 14, wherein the second side (127) of the base (120) comprises a hook/hole (128) for attaching the picture frame (100) to a rigid structure.

20. The picture frame (100) for displaying a picture template (200) according to claim 14, wherein a guide template (140) is provided to create exact alignment between the magnet(s) (124) of the internal backing (123) and the ferromagnetic metal plate (136) of the mat (130) during fabrication of the internal backing (123) and the mat (130) of the picture frame (100).

21. The picture frame (100) for displaying a picture template (200) according to claim 14, wherein the magnet(s) (124) are at least substantially concealed from the eyes of viewer.

22. The picture frame (100) for displaying a picture template (200) according to claim 14, wherein the mat (130) further comprising a plurality of locking tabs (134) for releasably holding the picture template (200).

23. The picture frame (100) for displaying a picture template (200) according to claim 14, wherein at least one picture is printed on a displaying portion (202) of the picture template (200).

24. The picture frame (100) for displaying a picture template (200) according to claim 14, wherein the picture and the picture template (200) are separate individual objects that could be removably connected to each other.

* * * * *